US005850204A

United States Patent [19]

Maekawa

[11] Patent Number: 5,850,204

[45] Date of Patent: Dec. 15, 1998

[54] LIQUID CRYSTAL DISPLAY DEVICE

[75] Inventor: Toshikazu Maekawa, Kanagawa, Japan

[73] Assignee: Sony Corporation, Japan

[21] Appl. No.: 774,681

[22] Filed: Dec. 26, 1996

Related U.S. Application Data

[63] Continuation of Ser. No. 856,725, Mar. 24, 1992, abandoned, which is a continuation of Ser. No. 473,833, Feb. 2, 1990, Pat. No. 5,166,671.

[30] Foreign Application Priority Data

Feb. 9, 1989 [JP] Japan ..... 1-030188

[51] Int. Cl.[6] ..... G09G 3/36

[52] U.S. Cl. ..... 345/98; 345/99; 345/100

[58] Field of Search ..... 345/98, 99, 100, 345/90, 92, 94, 95, 96, 87; 348/790, 791, 792, 793; 349/33, 34, 36, 37, 38, 39

[56] References Cited

U.S. PATENT DOCUMENTS 4,429,305 1/1984 Hosokawa et al. ..... 340/784
4,485,380 11/1984 Soneda et al. ..... 340/784
4,779,085 10/1988 Mizutome et al. ..... 340/784
4,789,899 12/1988 Takahashi et al. ..... 358/236
4,803,480 2/1989 Soneda et al. ..... 340/784
4,825,203 4/1989 Takede et al. ..... 340/784
4,864,182 9/1989 Fujioka et al. ..... 340/811
4,929,058 5/1990 Numao ..... 340/784

*Primary Examiner*—Xiao Wu
*Attorney, Agent, or Firm*—Roanld P. Kananen

[57] ABSTRACT

In a liquid crystal display device, sampling means and gate circuits are provided at every signal line, whereby a load in the sampling operation is reduced to carry out the sampling operation with ease. Simultaneously, the charge supplying time to the signal lines can be extended to thereby charge the signal lines by the signals satisfactorily. Thus, the quality of a displayed image can be prevented from being deteriorated.

12 Claims, 13 Drawing Sheets

Φ1H
Φ2H

Φ1V
Φ2V

φH1
φH2
φH3
φHm

φV1
φV2
φVn

VDD
VSS
Amplitude of Video Signal
VS
One Vertical Period
Target Voltage

FIG. 6
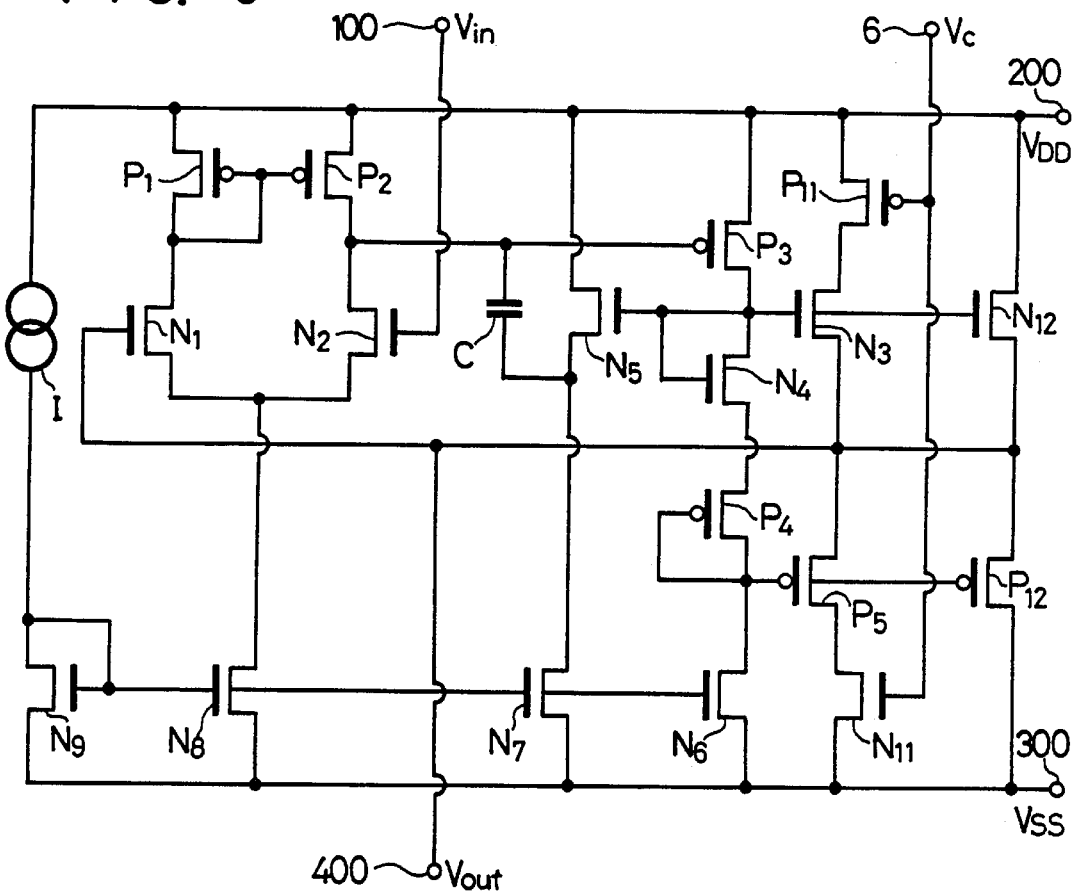
FIG. 7A Input Video Signal
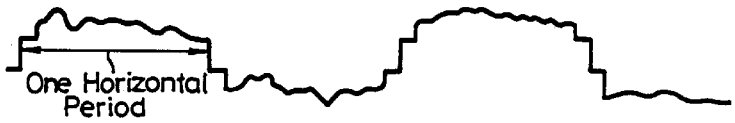
FIG. 7B $\phi_{Hi}$
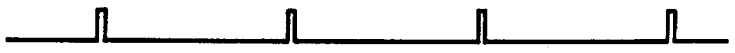
FIG. 7C $H_{BLK}$
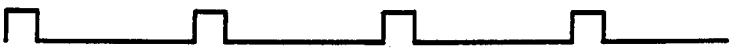
FIG. 7D $V_{in}$
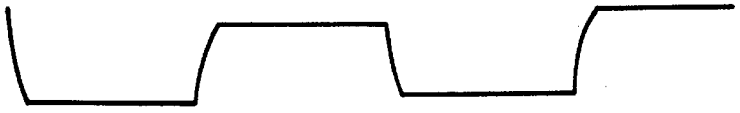
FIG. 7E $V_c$
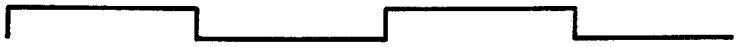
FIG. 7F Current
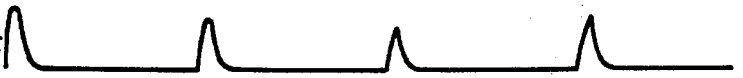

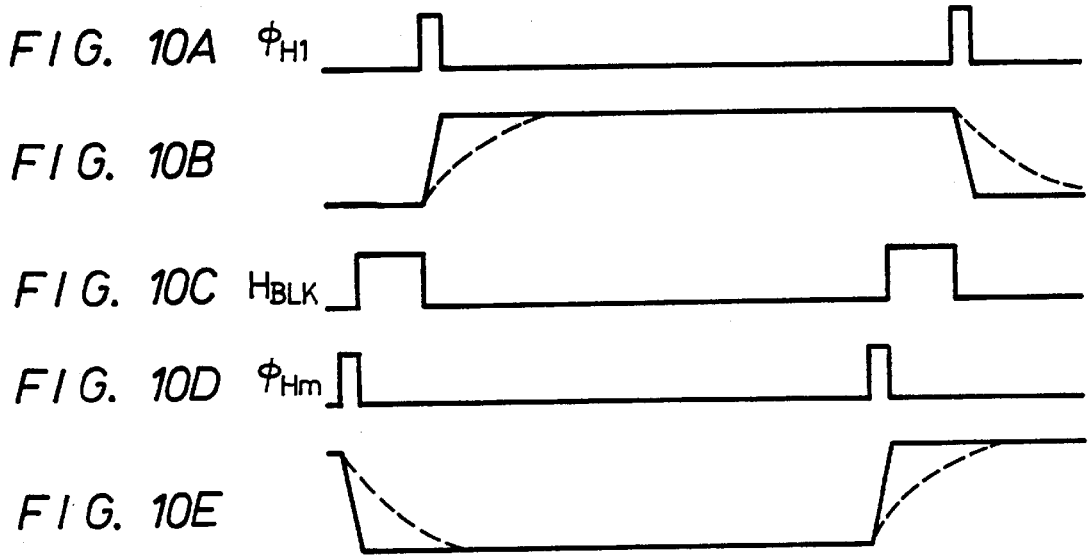
FIG. 10A
$\phi_{H1}$
FIG. 10B
FIG. 10C
$H_{BLK}$
FIG. 10D
$\phi_{Hm}$
FIG. 10E
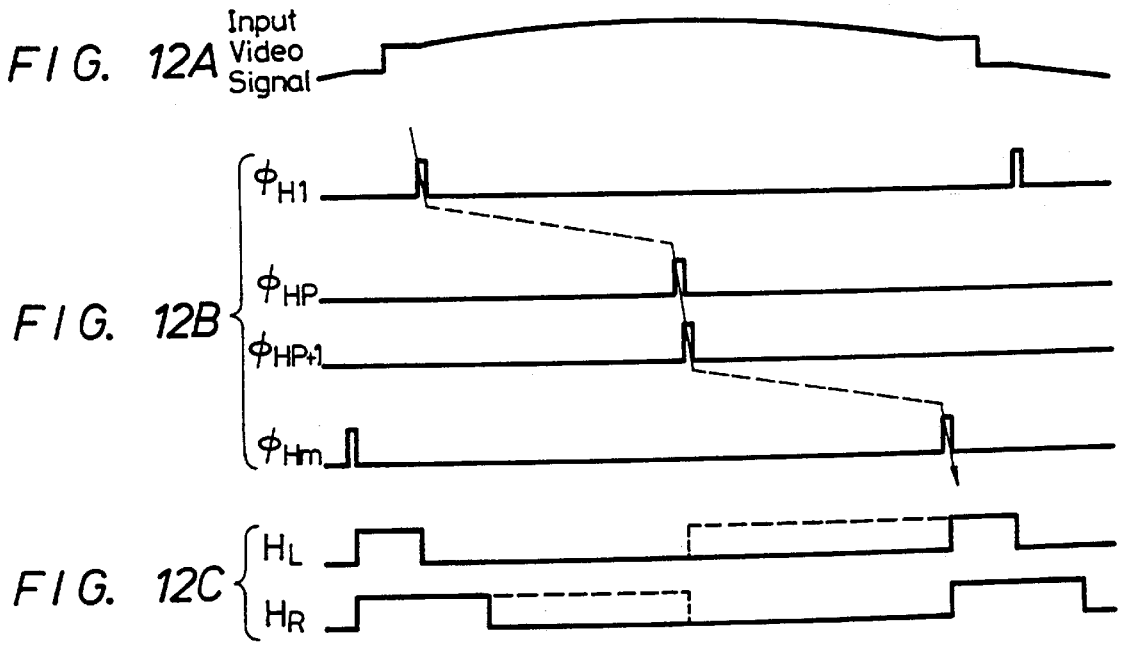
FIG. 12A
Input Video Signal
FIG. 12B
$\phi_{H1}$
$\phi_{HP}$
$\phi_{HP+1}$
$\phi_{Hm}$
FIG. 12C
$H_L$
$H_R$ FIG. 11A
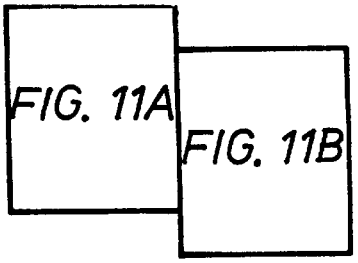
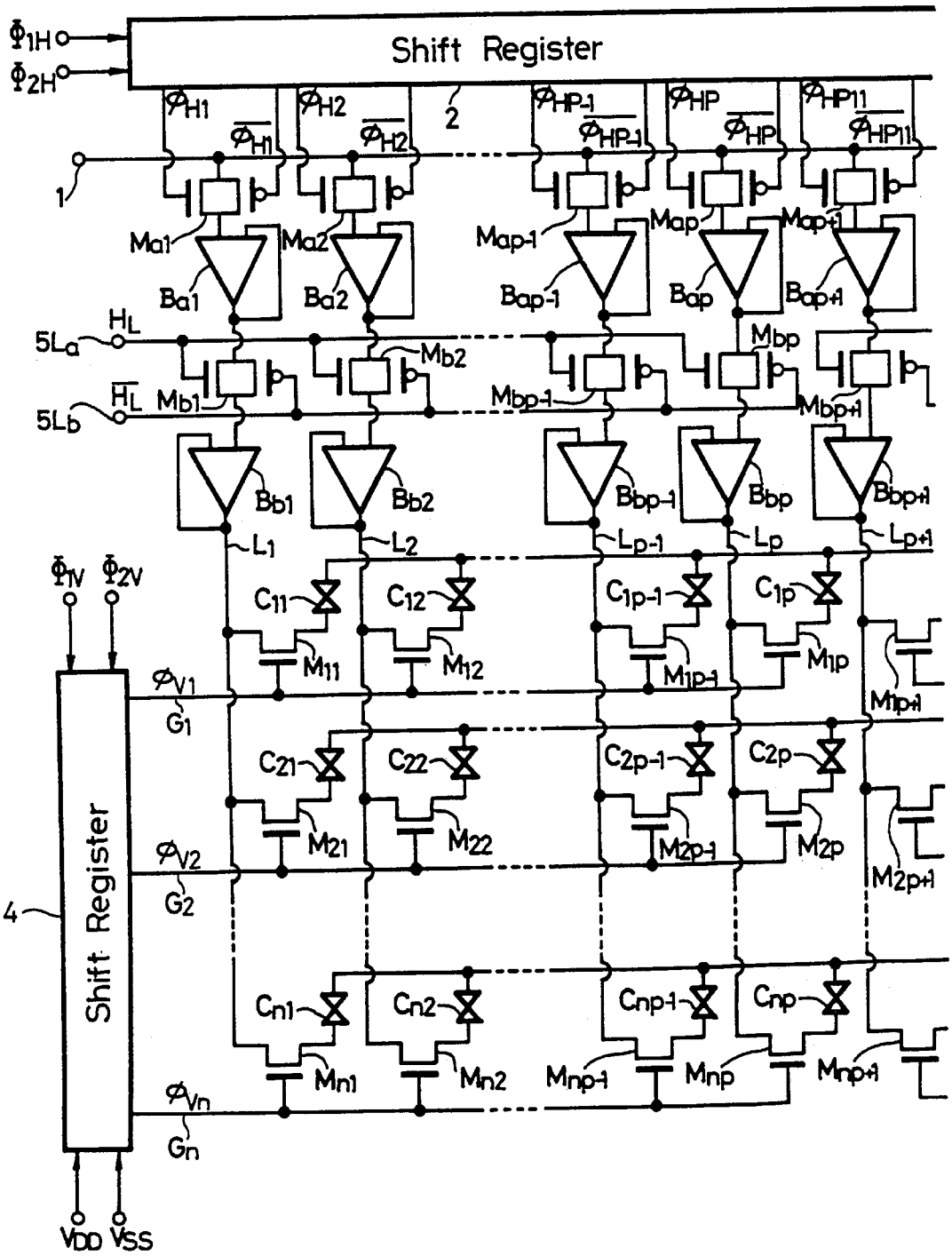

$\phi_{H1}$ $H_L$ $\phi_{Hm}$ $H_R$

FIG. 14A
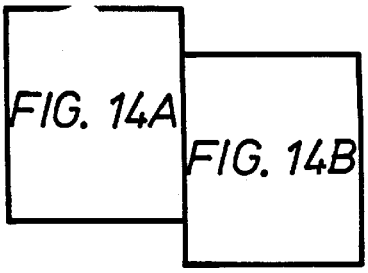
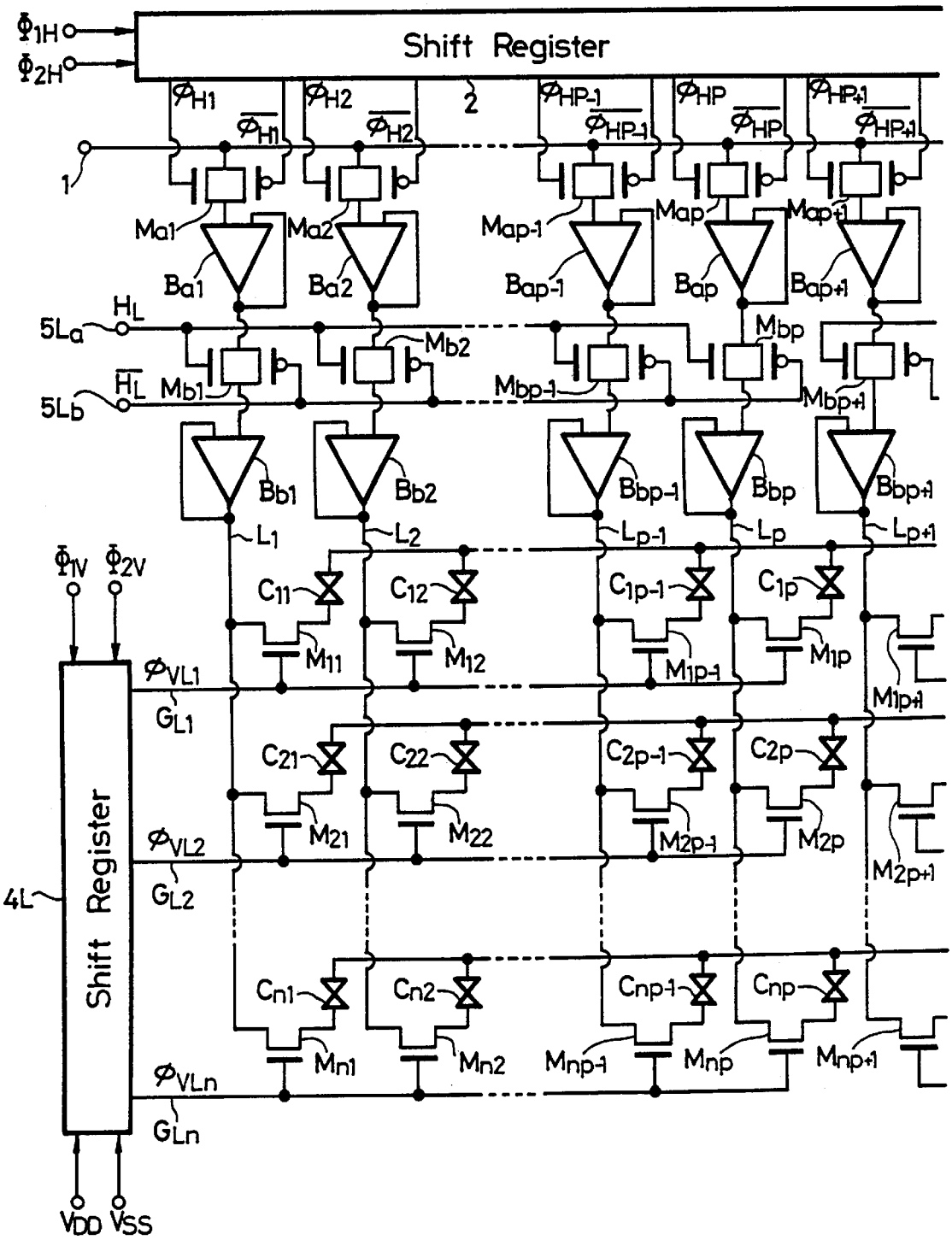

LIQUID CRYSTAL DISPLAY DEVICE

This application is a continuation of application Ser. No. 07/856,725 filed Mar. 24, 1992, now abandoned, which is a divisional application of Ser. No. 07/473,833, filed Feb. 2, 1990, now Pat. No. 5,166,671, issued Nov. 24, 1992.

BACKGROUND OF THE INVENTION

1. Field of the Invention

The present invention relates generally to liquid crystal display devices and, more particularly, is directed to a liquid crystal display device in which liquid crystal display elements are arranged in an X-Y matrix form to display a visual image.

2. Description of the Prior Art

Japanese Patent Laid-Open Gazette No. 59-220793 describes, for example, a liquid crystal display device which utilizes a liquid crystal to display a television picture. FIG. 1 shows an example of such prior-art liquid crystal display device.

Referring to FIG. 1, a television video signal is supplied to an input terminal 1, and the signal applied to the input terminal 1 is supplied through switching elements $M_1$, $M_2$, . . . , $M_m$, each being formed, for example, of an N-channel field effect transistor (FET), to lines $L_1$, $L_2$, . . . , $L_m$ in the vertical direction (Y-axis direction) where m represents the number corresponding to the number of pixels (picture elements) in the horizontal (X-axis) direction.

There is provided a shift register 2 having m stages, and the shift register 2 is supplied with clock signals $\phi_{1H}$ and $\phi_{2H}$ having a frequency of m times as high as the horizontal frequency. Drive pulse signals $\phi_{H1}$, $\phi_{H2}$, . . . , $\phi_{Hm}$, sequentially scanned by the clock signals H1 and H2 are supplied to control terminals of the switching elements $M_1$ to $M_m$ from the output terminals of the shift register 2. The shift register 2 is supplied with a low potential (low voltage) $V_{SS}$ and a high potential (high voltage) $V_{DD}$, and generates the drive pulse signal which goes to high level or low level.

The lines $L_1$ to $L_m$ are connected with one ends of switching elements $M_{11}$, $M_{21}$Mn1r $M_{12}$, $M_{22}$, . . . , Mn2f M1mi M2mr . Mnmr each being formed, for example, of an N-channel field effect transistor (FET) where n represents the number corresponding to the number of horizontal scanning lines. The other ends of the switching elements $M_{11}$ to $M_{nm}$ are connected through liquid crystal cells $C_{11}$ $C_{21}$, . . . , $C_{nm}$ to a target terminal 3.

Further, there is provided a shift register 4 of n stages. This shift register 4 is supplied with clock signals 01V and 02V having a horizontal frequency. Drive pulse signals fVil V2, . . . , IVn1 sequentially scanned by the clock signals ¢1V and b2V' are respectively supplied through gate lines $G_1$, $G_2$, . . . , $G_n$, aligned in the horizontal (X-axis) direction, to control terminals of the switching elements $M_{11}$ to M1m1 $M_{21}$ to M2mI Mnl to $M_{nm}$ aligned in the X-axis direction of the switching elements $M_{11}$ to $M_{nm}$ from the output terminals of the shift register 4. The shift register 4 is supplied with the low and high voltages $V_{SS}$ and $V_{DD}$, similarly to the shift register 2.

In the aforementioned circuit arrangement, the shift registers 2 and 4 are supplied with the clock signals (1H' (2Hr and 0V, 02V shown in FIGS. 2A and 2B, whereby the shift register 2 derives the drive pulse signals fH1 to fHm shown in FIG. 2C, at every pixel period, and the shift register 4 derives the drive pulse signals fV i to 0Vn' shown in FIG. 2D, at every horizontal period. A video signal shown in FIG. 2E is supplied to the input terminal 1.

When the drive pulse signals IV1 and fH1 are produced from the shift registers 4 and 2, the switching element $M_1$ and the switching elements Mi, to Mim are turned ON to form a current path formed of the input terminal 1, the switching element $M_1$, the line $L_1$, the switching element M1, the liquid crystal cell $C_{11}$ and the target terminal 3, in that order, whereby a potential difference between the signal applied to the input terminal 1 and the signal at the target terminal 3 is supplied to the liquid crystal cell $C_{11}$. Accordingly, a charge corresponding to the potential difference, brought about by a signal of a first pixel, is sample-and-held in the capacity of the liquid crystal cell $C_{11}$, and an optical transmissivity of liquid crystal cell is changed in response to the amount of charges. The liquid crystal cells $C_{12}$ to $C_{nm}$ are similarly driven in that order, and the amounts of charge in the liquid crystal cells $C_{11}$ to $C_{nm}$ are rewritten when a signal of the next field is supplied to the input terminal 1.

In this fashion, optical transmissivities of the liquid crystal cells $C_{11}$ to $C_{nm}$ are varied in response to the respective pixels of the video signal, and this operation is sequentially repeated to display a television picture.

In general, the liquid crystal display device is driven to display a picture by an AC voltage in order to increase a reliability thereof and a life thereof. For example, when a television picture is displayed, a signal in which a video signal is inverted at every field or at every frame is supplied to the input terminal 1. Further, in the liquid crystal display device, a signal is inverted at every horizontal period in order to avoid a so-called shooting in the vertical direction of a displayed image and so on.

More specifically, the input terminal 1 is supplied with a video signal which is inverted at every horizontal period and which is inverted at every field or at every frame as shown in FIG. 2E.

In the above-described liquid crystal display device, a duration of each of the drive pulse signals H1 to fHm derived from the shift register 2 is determined as duration of horizontal effective picture screen period number of horizontal pixels For example, in the case of the NTSC video signal, a duration of a drive pulse signal is about 100 nanoseconds. When the above-described liquid crystal display device is applied to a high definition television receiver (HDTV), a time of horizontal effective picture screen period becomes about one-half and the number of horizontal pixels is increased by about three times, whereby the duration of the above-mentioned drive pulse signal is reduced to about one-sixth.

Whereas, the video signal, passing through the switching elements $M_1$ to Mm during the period of the drive pulse signals H1 to fHm' are supplied through the lines $L_1$ to $L_m$ to the switching elements $Ml_1$ to $M_{nm}$. In that case, a wiring capacity of 10 to several 10s of picofarads exists in each of the lines $L_1$ to $L_m$ so that the video signal charges this capacity and is then supplied to the switching elements $M_{11}$ to $M_{nm}$.

In that case, if a period in which the video signal is supplied is about 100 nanoseconds, the above-mentioned charged voltage is increased to a signal potential. If the charging time is reduced to one-sixth, when the video signal is at a high potential (white or black), the charging is not carried out satisfactorily so that only an unclear picture having insufficient contrast or the like is displayed. In the case of the HDTV system, the wiring capacity is increased more.

In order to avoid the above-mentioned defects, U.S. Pat. No. 4,447,812 describes the following proposal. In this proposal, an input video signal is converted to parallel signals of three pixels each by using delay means whose delay time corresponds, for example, to a period of one to two pixels. The resultant parallel signals are supplied through three of the switching elements $M_1$ to $M_m$ to the lines $L_1$ to $L_m$, and the three switching elements are driven by a common drive pulse signal, whereby a duration of a pulse signal can be increased, for example, by about three times.

In this proposal, the characteristics of delay means for providing the parallel signals or the like must be made uniform at very high accuracy, otherwise a fixed pattern of low frequency appears in the displayed image and the image quality is considerably deteriorated. In the liquid crystal display device, the shift register 2 can be driven at very high speed when the liquid crystal display device is applied to the HDTV system.

OBJECTS AND SUMMARY OF THE INVENTION

Therefore, it is an object of the present invention to provide an improved liquid crystal display device which can eliminate the defects encountered with the prior art.

More specifically, it is an object of the present invention to provide an improved liquid crystal display device which can prevent the quality of displayed image from being deteriorated.

It is another object of the present invention to provide an improved liquid crystal display device which can be made inexpensive.

It is a further object of the present invention to provide an improved liquid crystal display device which can be designed with ease.

It is still another object of the present invention to provide an improved liquid crystal display device suitable for the application to a high definition television receiver.

In accordance with a first aspect of the present invention, a liquid crystal display device is provided, in which a plurality of first signal lines are extended in parallel to each other in a vertical direction and a plurality of second signal lines are extended in parallel to each other in a horizontal direction wherein liquid crystal cells are respectively provided at intersections of the first and second signal lines through selecting elements. This liquid crystal display device is comprised of a horizontal scanner having output portions corresponding to the first signal lines, a plurality of sampling devices for sampling an input video signal in response to pulse signals sequentially produced from the output portions of the horizontal scanner, a plurality of first buffer amplifiers for holding signals from the sampling devices, a plurality of gate circuits for allowing signals from the first buffer amplifiers to pass therethrough during a horizontal blanking period, and a plurality of second buffer amplifiers supplied with the signals passed through the gate circuits and for respectively supplying the signals to the first signal lines, wherein the first and second signal lines, the selecting elements and the liquid crystal cells are formed in an on-chip fashion.

As a second aspect of this invention, a liquid crystal display device is provided, in which a plurality of first signal lines are extended in parallel to each other in a vertical direction and a plurality of second signal lines are extended in parallel to each other in a horizontal direction wherein liquid crystal cells are respectively provided at intersections of the first and second signal lines through selecting elements. This liquid crystal display device is comprised of a horizontal scanner having output portions corresponding to the first signal lines, a plurality of horizontal switches which are sequentially turned ON by pulse signals sequentially produced from the output portions of the horizontal scanner, a plurality of hold devices supplied with an input video signal through the horizontal switches, and a plurality of load devices for respectively supplying signals from the hold devices to the first signal lines, wherein the load devices are divided in the horizontal direction to provide a plurality of groups so that the load devices at every divided group are turned ON during a period other than a period in which the horizontal switches belonging to the load devices of at least the group are turned ON.

As a third aspect of the present invention, a liquid crystal display device is provided, in which a plurality of first signal lines are extended in parallel to each other in a vertical direction and a plurality of second signal lines are extended in parallel to each other in a horizontal direction wherein liquid crystal cells are respectively provided at intersections of the first and second signal lines through selecting elements. This liquid crystal display device is comprised of a plurality of horizontal switches which are sequentially turned ON by pulse signals sequentially produced from a horizontal scanner, a plurality of hold devices respectively supplied with an input video signal through the horizontal switches, and a plurality of buffer circuits for respectively loading signals from the hold devices to the first signal lines, wherein the input video signal is inverted in polarity at a predetermined cycle and charging and discharging paths within the buffer circuits are switched at a timing in which the video signal is inverted in polarity.

The above, and other objects, features and advantages of the present invention, will be apparent in the following detailed description of preferred embodiments to be read in conjunction with the accompanying drawings, in which like reference numerals are used to identify the same or similar parts in the several views.

BRIEF DESCRIPTION OF THE DRAWINGS

FIG. 6 is a schematic diagram showing an example of an improved buffer amplifier used in the present invention;

FIGS. 7A to 7F are waveform diagrams of an input video signal, a drive pulse signal, a horizontal blanking pulse, a sample-and-held signal, a control signal and a current, and to which reference will be made in explaining an operation of the improved buffer amplifier of FIG. 6, respectively;

FIGS. 10A to 10E are waveform diagrams of a drive pulse signal and a horizontal blanking pulse, and to which reference will be made in explaining the first embodiment of this invention more fully, respectively;

FIGS. 12A to 12*c* are waveform diagrams of an input video signal, a drive pulse signal and a load signal, and to which reference will be made in explaining an operation of the second embodiment of this invention, respectively;

DETAILED DESCRIPTION OF PREFERRED EMBODIMENTS

Figure 3:
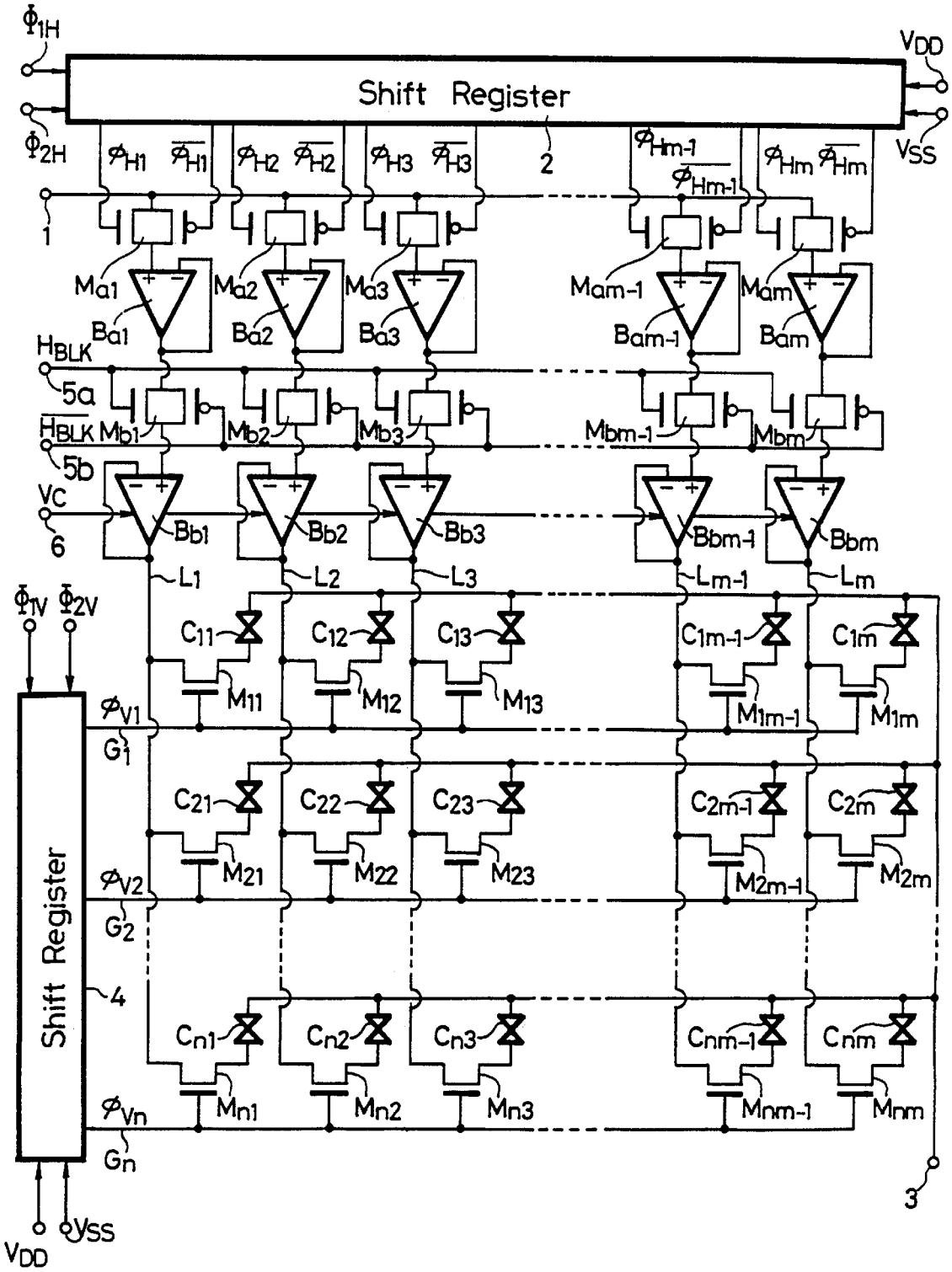
FIG. 3 is a schematic diagram showing a liquid crystal display device according to a first embodiment of the present invention.

Referring to the drawings in detail, and initially to FIG. 3, there is provided a liquid crystal display device according to a first embodiment of the present invention and whose elements are all formed in a so-called on-chip fashion.

As FIG. 3 shows, a video signal applied to an input terminal 1 is commonly supplied to complementary metal oxide semiconductor (CMOS) elements $M_{a1}, M_{a2}, \ldots, M_{am}$ which form sampling means. Drive pulse signals $\phi_{H1}$ to $\phi_{Hm}$ and $\overline{\phi_{H1}}$ to $\overline{\phi_{Hm}}$ from the shift register 2 are supplied to control terminals of these CMOS elements $M_{a1}$ to $M_{am}$, respectively.

The video signals from these CMOS elements $M_{a1}$ to $M_{am}$ are supplied to non-inverting input terminals of buffer amplifiers $B_{a1}, B_{a2}, \ldots, B_{am}$, whereas outputs from the buffer amplifiers $B_{a1}$ to $B_{am}$ are fed back to inverting input terminals thereof. Signals from the buffer amplifiers $B_{a1}$ to $B_{am}$ are respectively supplied to CMOS elements $M_{b1}, M_{b2}, \ldots, M_{bm}$ each of which forms a gate circuit. Horizontal blanking pulses $H_{BLK}$ and $\overline{H_{BLK}}$ applied to terminals 5*a* and 5*b* are supplied to control terminals of these CMOS elements $M_{b1}$ to $M_{bm}$. The horizontal blanking pulses $H_{BLK}$ and $\overline{H_{BLK}}$ are coincident with the horizontal blanking period of the video signal applied to the input terminal 1 from a timing standpoint.

Figure 1:
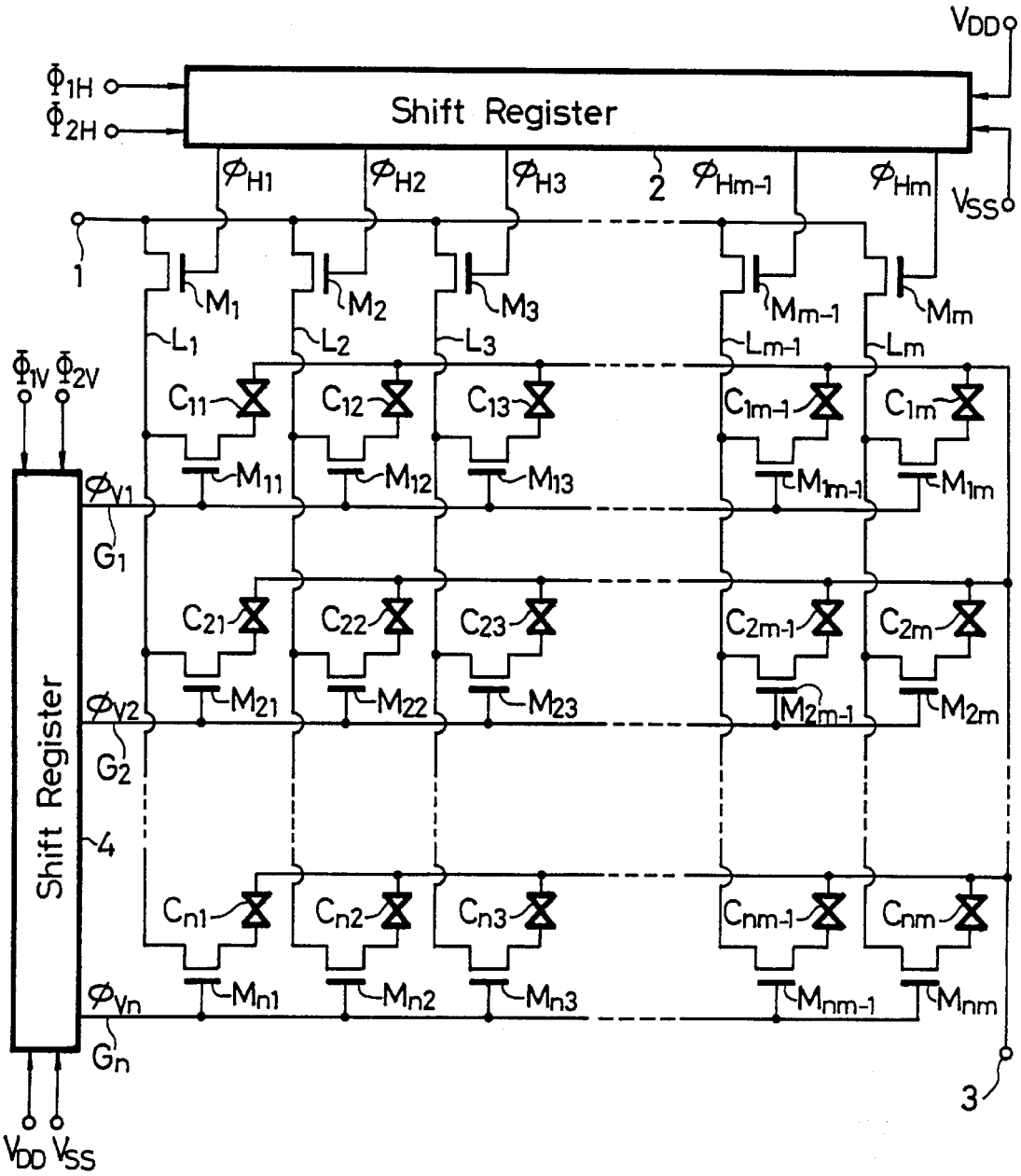
FIG. 1 (PRIOR ART)
FIG. 1 is a schematic diagram showing a main portion of an example of a prior-art liquid crystal display device.
Figures 2A, 2B, 2C, 2D, 2E:
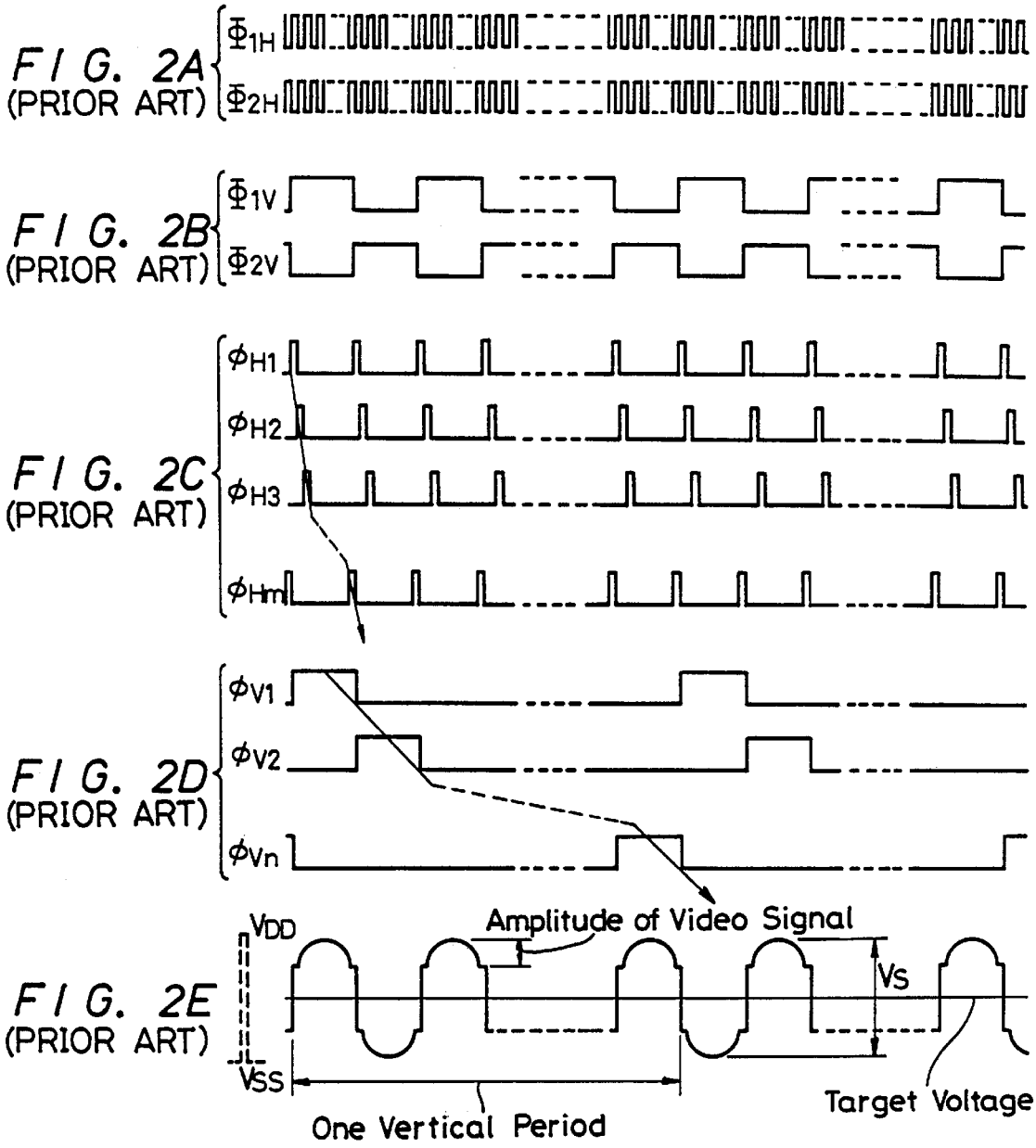
FIG. 2A (PRIOR ART)
FIG. 2B (PRIOR ART)
FIG. 2C (PRIOR ART)
FIG. 2D (PRIOR ART)
FIG. 2E (PRIOR ART)
FIGS. 2A to 2E are timing charts to which reference will be made in explaining an operation of the prior art shown in FIG. 1, respectively.

Signals from these CMOS elements $M_{b1}$ to $M_{bm}$ are respectively supplied to non-inverting input terminals of buffer amplifiers $B_{b1}, B_{b2}, \ldots, B_{bm}$, whereas outputs of the buffer amplifiers $B_{b1}$ to $B_{bm}$ are fed back to inverting input terminals thereof. Video signals from the buffer amplifiers $B_{b1}$ to $B_{bm}$ are supplied to lines $L_1$ to $L_m$ aligned in the vertical (Y-axis) direction, respectively. Other elements are formed similarly to those of the prior-art liquid crystal display device shown in FIG. 1, and therefore need not be described in detail.

An operation of this liquid crystal display device will be described next with reference to, for example, FIGS. 4A to 4C.

Figure 4A:
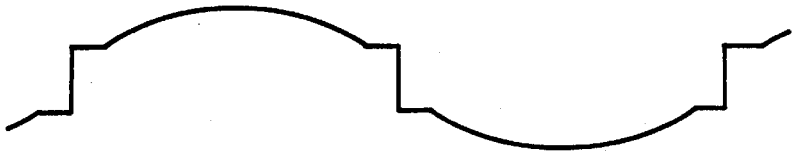
FIGS. 4A to 4C are waveform diagrams of an input video signal, drive pulse signals and a horizontal blanking pulse, and to which reference will be made in explaining an operation of the first embodiment of this invention, respectively.
Figure 4B:
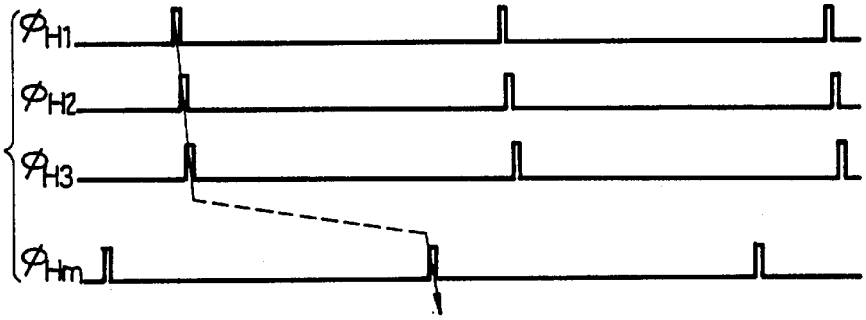
Figure 4C:
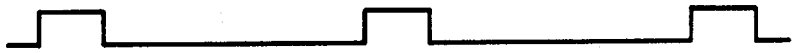

When a video signal shown in FIG. 4A is supplied to the input terminal 1, the CMOS elements $M_{a1}$ to $M_{am}$ are turned ON by drive pulses 1H to $\phi_{Hm}$ shown in FIG. 4B, and the video signals during this ON-state period are sample-and-held by the buffer amplifiers $B_{a1}$ to $B_{am}$. Whereas, the CMOS elements $M_{b1}$ to $M_{bm}$ are turned ON at the timings of horizontal blanking pulse $H_{BLK}$ shown in FIG. 4C. The video signals thus held are respectively supplied through the buffer amplifiers $B_{b1}$ to $B_{bm}$ to the lines $L_1$ to $L_m$. Thus, a picture is displayed similarly to the prior art.

In the above-described liquid crystal display device, the samplings of the video signals in the CMOS elements $M_{a1}$ to $M_{am}$ can be carried out at a sufficiently high speed since the wiring capacity to the buffer amplifiers $B_{a1}$ to $B_{am}$ is very small and only the buffer amplifiers are driven and hence the load is very small. Further, the buffer amplifiers $B_{a1}$ to $B_{am}$ and the CMOS elements $M_{b1}$ to $M_{bm}$ are operated during a relatively long horizontal blanking period so that they can be operated by a circuit utilizing a standard thin film transistor (TFT) or the like. Furthermore, the buffer amplifiers $B_{b1}$ to $B_{bm}$ are adapted to charge the lines $L_1$ to $L_m$ during the horizontal effective picture screen period with the result that they can be realized satisfactorily by a standard circuit. Thus, the amounts of charges in all liquid crystal cells can be satisfactorily rewritten, whereby a picture having excellent contrast or the like can be displayed satisfactorily.

According to the liquid crystal display device of the first embodiment of the present invention, sampling means and the gate circuits are provided at every signal line, whereby the sampling operation can be carried out with ease by reducing the load in the sampling mode. Simultaneously, the charging by the signal can be satisfactorily carried out by increasing the time in which the video signals are supplied to the signal lines, and thus the quality of a displayed picture can be prevented from being deteriorated.

While all elements $M_{a1}$ to $M_{am}$ and $M_{b1}$ to $M_{bm}$ are the CMOS elements in the above-described liquid crystal display device, they may be formed of N-type metal oxide semiconductor (NMOS) elements.

Figure 5:
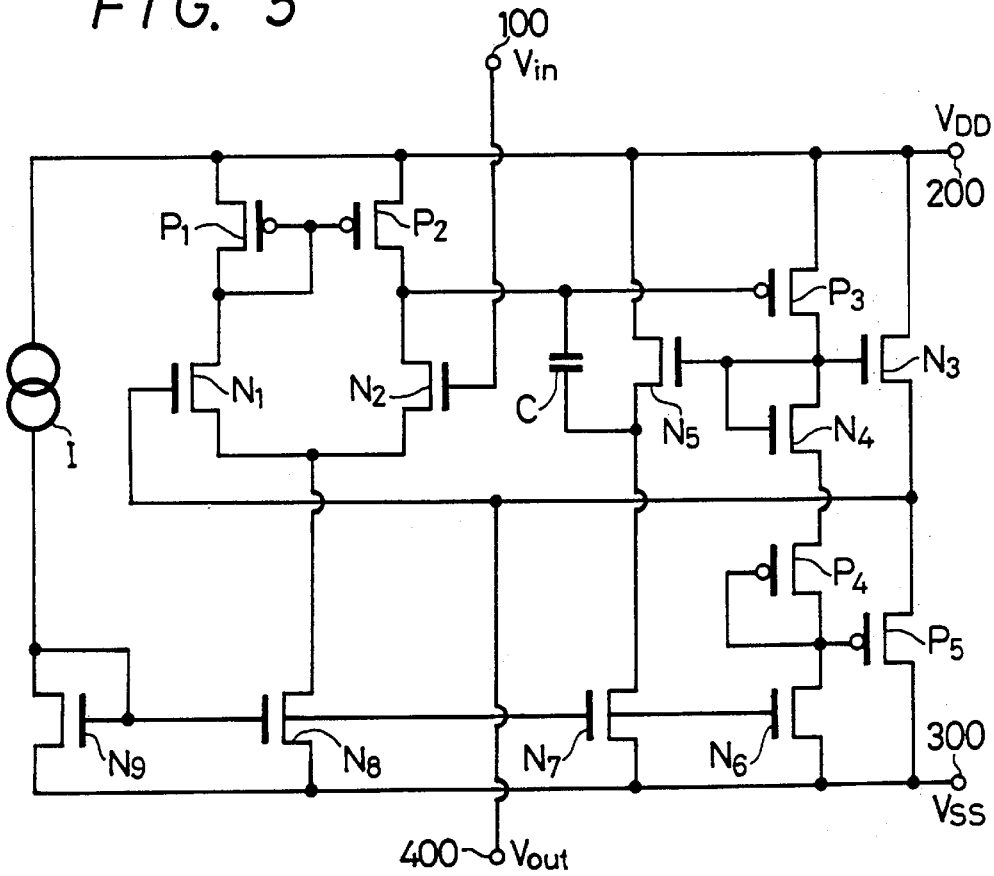
FIG. 5 is a schematic diagram showing an example of a buffer amplifier used in the first embodiment of FIG. 3.

In the above-described liquid crystal display device, each of the buffer amplifiers $B_{a1}$ to $B_{am}$ and $B_{b1}$ to $B_{bm}$ is an amplifier having a gain of "1", and is constructed, for example, by a TFT as shown in FIG. 5.

Referring to FIG. 5, there is provided a differential amplifier which is comprised of NMOS elements $N_1$ and $N_2$. An input signal (Vin) applied to a terminal 100 is supplied to the gate electrode of one element $N_2$, and the drain electrodes of the elements $N_1$ and $N_2$ are connected to each other via a current mirror circuit formed of P-type metal oxide semiconductor (PMOS) elements $P_1$ and $P_2$, and are connected to a terminal 200 to which the high voltage $V_{DD}$ is applied. The drain electrode of the element $N_2$ is connected to the gate electrode of PMOS element $P_3$ whose drain electrode is connected to the terminal 200 to which the high voltage $V_{DD}$ is supplied. The source electrode of the element $P_3$ is connected to the gate electrode of an NMOS element $N_3$ whose drain electrode is connected to the terminal 200. Further, the source electrode is connected to the drain electrode and the gate electrode of NMOS element $N_4$ whose source electrode is connected to the drain electrode of a PMOS element $P_4$. The gate electrode and the source electrode of the element $P_4$ are connected to the gate electrode of PMOS element $P_5$ whose source electrode is connected to a terminal 300 to which the low potential $V_{SS}$ is applied. The source electrode of the element $N_3$ and the drain electrode of the element $P_5$ are connected to each other, and a junction therebetween is connected to the gate electrode of the element $N_1$. An output terminal 400 is led out from the above-described junction. The source electrode of the element $P_3$ is connected to the gate electrode of NMOS element $N_5$ whose drain electrode is connected to the terminal 200. The source electrode of the element $N_5$ is connected through a capacitor C to the drain electrode of the element $N_2$. Elements $N_6$ to $N_8$ constitute a bias current source through which a current from a constant current source I is flowed via an element $N_9$ which forms a current mirror circuit.

Accordingly, in this circuit, the elements $N_1$, $N_2$, $N_8$, $P_1$ and $P_2$ constitute a high gain amplifier of the first stage, and the elements $P_3$, $P_4$, $N_4$ and $N_6$ constitute an amplifier of the next stage and a level shifter. The elements $N_3$ and $P_5$ constitute an output buffer, and the elements $N_5$, $N_7$ and the capacitor C constitute a phase compensating circuit.

When the wiring capacity of the lines $L_1$ to $L_m$ is employed as a load for the above-described circuit similarly to the buffer amplifiers $B_{b1}$ to $B_{bm}$, this wiring capacity is very large and therefore the elements $N_3$ and $P_5$ at the output stage must be increased in size. In that case, according to the above-mentioned circuit arrangement, a predetermined penetrating current is flowed through the elements $N_3$ and $P_5$ regardless of the level of the input signal so that, when the elements $N_3$ and $P_5$ are large in size, a power consumption by the penetrating current becomes as large as that can not be neglected.

Further, when the circuit of this embodiment is applied to the HDTV system, more than 1000 of the above-mentioned buffer amplifiers are required, which provides a large total amount of the penetrating currents.

Furthermore, the penetrating current is easily changed by the fluctuation of a process or the like so that a yield provided when the liquid crystal display device is fabricated as a one-chip large scaled integrated (LSI) circuit is degraded.

An improved buffer amplifier will be described next with reference to the drawings.

Improved buffer amplifiers $B_{b1}$ to $B_{bm}$ are constructed as, for example, shown in FIG. 6. In FIG. 6, like parts corresponding to those of the buffer amplifier shown in FIG. 5 are marked with the same references and therefore need not be described.

As shown in FIG. 6, a PMOS element $P_{11}$ is connected between the drain electrode of the element $N_3$ and the terminal 200 to which the high voltage $V_{DD}$ is applied. An NMOS element $N_{11}$ is connected between the source electrode of the element $P_5$ and the terminal 300 to which the low voltage $V_{SS}$ is applied. A control voltage Vc applied to the terminal 6 is supplied to the gate electrodes of these elements $N_{11}$ and $P_{11}$. An NMOS element $N_{12}$ and a PMOS element $P_{12}$ are provided and whose gate electrodes are commonly connected to the elements $N_3$ and $P_5$. The drain electrode of the element $N_{12}$ is connected to the terminal 200, and the source electrode of the element $P_{12}$ is connected to the terminal 300. The source electrode of the element $N_{12}$ and the drain electrode of the element $P_{12}$ are connected to each other, and the junction therebetween is connected to a junction between the source electrode of the element $N_3$ and the drain electrode of the element $P_5$. Other elements are formed similarly to those of the buffer amplifier shown in FIG. 5. An operation of this buffer amplifier will be described hereinunder.

In the liquid crystal display device of FIG. 3, the input terminal 1 is supplied with an input video signal whose polarity is inverted at every horizontal period as shown in FIG. 7A. For this input video signal, the element $M_{ai}$ is turned ON by a drive pulse $\phi_{Hi}$ whose waveform is shown, for example, in FIG. 7B. When the element $M_{bi}$ is turned ON by a horizontal blanking pulse $H_{BLK}$ whose waveform is shown in FIG. 7C, the buffer amplifier $B_{bi}$ is supplied with a signal Vin which is sample-and-held as shown in FIG. 7D. The terminal 6 is supplied with the control signal Vc whose polarity is inverted, as shown in FIG. 7E, at the same timing in which the polarity of the input signal is inverted.

Figure 8A:
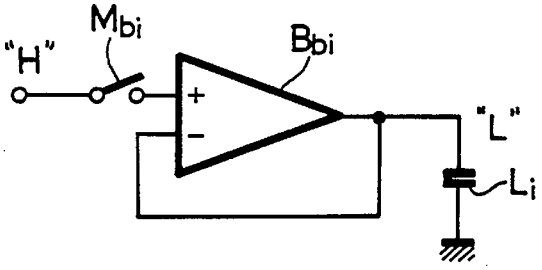
FIGS. 8A, 8A' and FIGS. 8B, 8B' are schematic diagrams useful for explaining the operation of the improved buffer amplifier of FIG. 6, respectively.
Figure 8A:
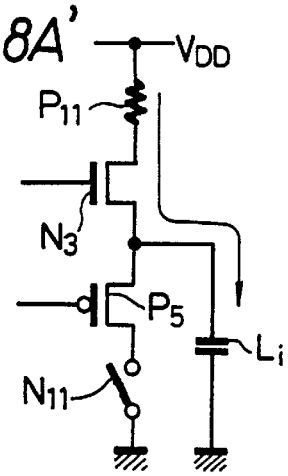

When the signal, applied to the line $L_i$ one horizontal period before, is at "L" (low) level and a new signal, to be applied to the element $M_{bi}$, is at "H" (high) level as shown in FIG. 8A, the buffer amplifier $B_{bi}$ charges the potential of the line $L_i$ from (polarity inverting central voltage Vcom—signal voltage Vsig) to (Vcom+Vsig). In that case, if the control signal Vc is at low potential, in the above buffer amplifier circuit, the element $P_{11}$ is turned ON and the element $N_{11}$ is turned OFF, whereby as shown in FIG. 8A' the element $P_{11}$ becomes an impedance and the wiring capacity of the line $L_i$ is charged through the elements $P_{11}$ and $N_3$ by the voltage source $V_{DD}$. Thus, the element $N_{11}$ is turned OFF to interrupt the element $P_5$.

Figure 8B:
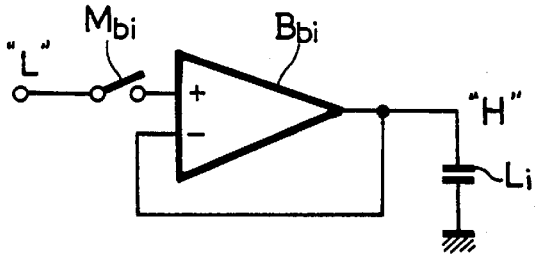
Figure 8B:
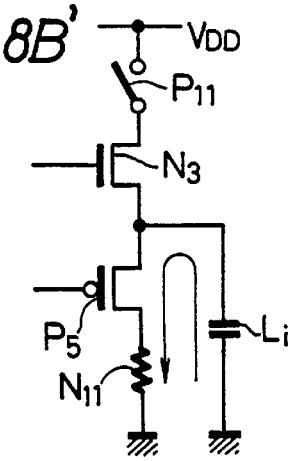

When a signal, supplied to the line $L_i$ one horizontal period before, is at "H" level and a signal, to be supplied to the element $M_{bi}$, is at "L" level as shown in FIG. 8B, then the buffer amplifier $B_{bi}$ discharges the potential of the line $L_i$ from (Vcom+Vsig) to (Vcom−Vsig). In that case, if the control signal Vc is at high potential, the element $P_{11}$ is turned OFF and the element $N_{11}$ is turned ON in the above-mentioned buffer amplifier circuit arrangement, as shown in FIG. 8B', the element $N_{11}$ becomes an impedance so that the wiring capacity of the line $L_i$ is discharged to the voltage source terminal $V_{SS}$ via the elements $P_5$ and $N_{11}$. Therefore, the element $P_{11}$ is turned OFF to interrupt the element $N_3$. Accordingly, the current, flowing through the buffer amplifier, is the current which relates to the charge and discharge as shown in FIG. 7F, thereby avoiding the occurrence of the penetrating current.

In the circuit arrangement of the buffer amplifier as described above, the elements $N_{12}$ and $P_{12}$ are provided in order to slightly decrease the output impedance and to reduce an influence of an external disturbance. The elements $N_{12}$ and $P_{12}$ are small in size as compared with the elements $N_3$ and $P_5$.

As described above, according to the liquid crystal display device of the first embodiment, the charging and discharging signal paths of the buffer circuit for loading the video signal are changed-over at the same timing as that provided in which the polarity of the signal is inverted, whereby a penetrating current within the buffer circuit can be reduced. Thus, the power consumption of the overall arrangement of the liquid crystal display device can be considerably reduced.

According to the above-described device, since no penetrating current flows, the fluctuation of current by the processing is reduced and the yield of the device can be improved.

According to the liquid crystal display device of the present invention, all currents flowing through the element $N_3$ or $P_5$ are utilized to perform the charge and discharge, whereby the signal can rise and fall readily as compared with the prior art. Further, the size of the elements can be reduced as compared with the prior art so that, when the elements $N_{11}$, $N_{12}$, $P_{11}$, $P12$ and the like are provided, the chip area can be prevented from being increased.

Figure 9:
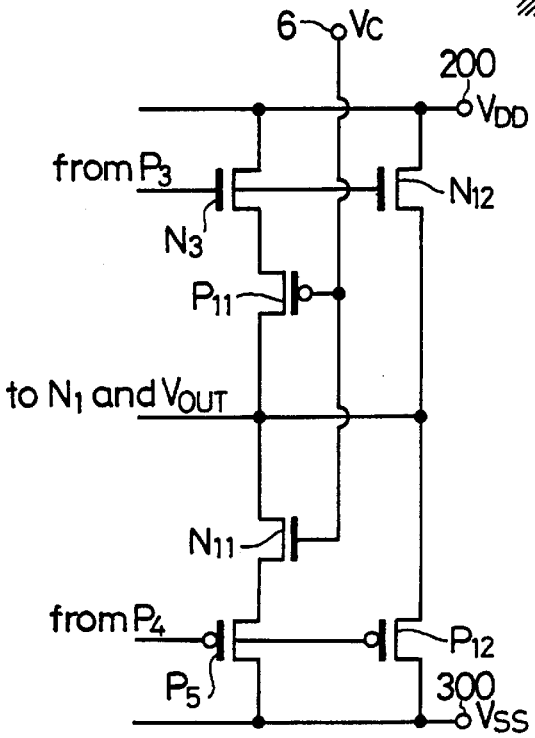
FIG. 9 is a schematic diagram showing a main portion of a modified example of the improved buffer amplifier of FIG. 6.

In the above-described liquid crystal display device, as shown in FIG. 9, the elements $P_{11}$ and $N_{11}$ are provided inside of the elements $N_3$ and $P_5$ with the same action and effect being achieved.

While the input video signal is inverted in polarity at every horizontal period as described above, the input video signal may be inverted in polarity at every desired number of horizontal periods. In that case, the charging and discharging operations which occur when the polarity of the input video signal is inverted are carried out in the elements $N_3$ and $P_5$, whereas the signal change between the respective horizontal periods is charged and/or discharged by the elements $N_{12}$ and $P_{12}$. In other words, the above-described liquid crystal display device can be interpreted such that the charging and discharging of a large amount by the inversion of polarity are carried out by the elements of large size with the switching function, whereas the charging and discharging of a small amount therebetween are continuously carried out by the elements of small size.

According to the aforementioned circuit arrangement of the buffer amplifier, the charging and discharging signal paths of the buffer circuit for loading the video signal are changed-over at the same timing as that in which the polarity of the video signal is changed-over, whereby the penetrating current within the buffer circuit can be reduced and the power consumption in the overall arrangement of the liquid crystal display device can be considerably reduced.

In the liquid crystal display device of FIG. 3, the video signals are sampled in the elements $M_{a1}$ to $M_{am}$ by driving the small wiring capacity up to the buffer amplifiers $B_{a1}$ to $B_{am}$ and only the buffer amplifiers, whereby the load is small and the sampling operation can be carried out at high speed. However, it takes a relatively long period of time for the signals to move in the buffer amplifiers $B_{a1}$ to $B_{am}$. There is then the risk that the movement of the signal is not satisfactorily effected in the vertical signal line of the right end portion of the display during the horizontal blanking period provided just after the sampling operation. This defect will be explained hereinunder with reference to FIGS. 10A to 10E.

Although a signal, sampled by a drive pulse signal $\phi_{H1}$ shown in FIG. 10A, is moved at high speed by the switching element $M_{a1}$ as shown by a solid line in FIG. 10B, a signal is moved at a relatively low speed in the buffer amplifier $B_{a1}$ so that the output signal from the buffer amplifier $B_{a1}$ rises with much time as shown by a broken line in FIG. 10B. In that case, however, there is a time to spare for the next horizontal blanking period $H_{BLK}$ as shown in FIG. 10C so that the supply (load) of the signal to the line $L_1$ can be effected satisfactorily.

Although a signal, sampled by a drive pulse signal $\phi_{Hm}$ corresponding to the right end portion of the picture screen as shown in FIG. 10D, is moved in the switching element $M_{am}$ as shown by a solid line in FIG. 10E, the movement of the above-described signal in the buffer amplifier $B_{am}$ is not yet finished until the end of the horizontal blanking period $H_{BLK}$ as shown by a broken line in FIG. 10E. As a result, the supply (load) of the signal to the line $L_m$ becomes insufficient. There is then the substantial possibility that such unsatisfactory signal appears on the right end portion of the picture screen as a so-called shading.

Figure 11B:
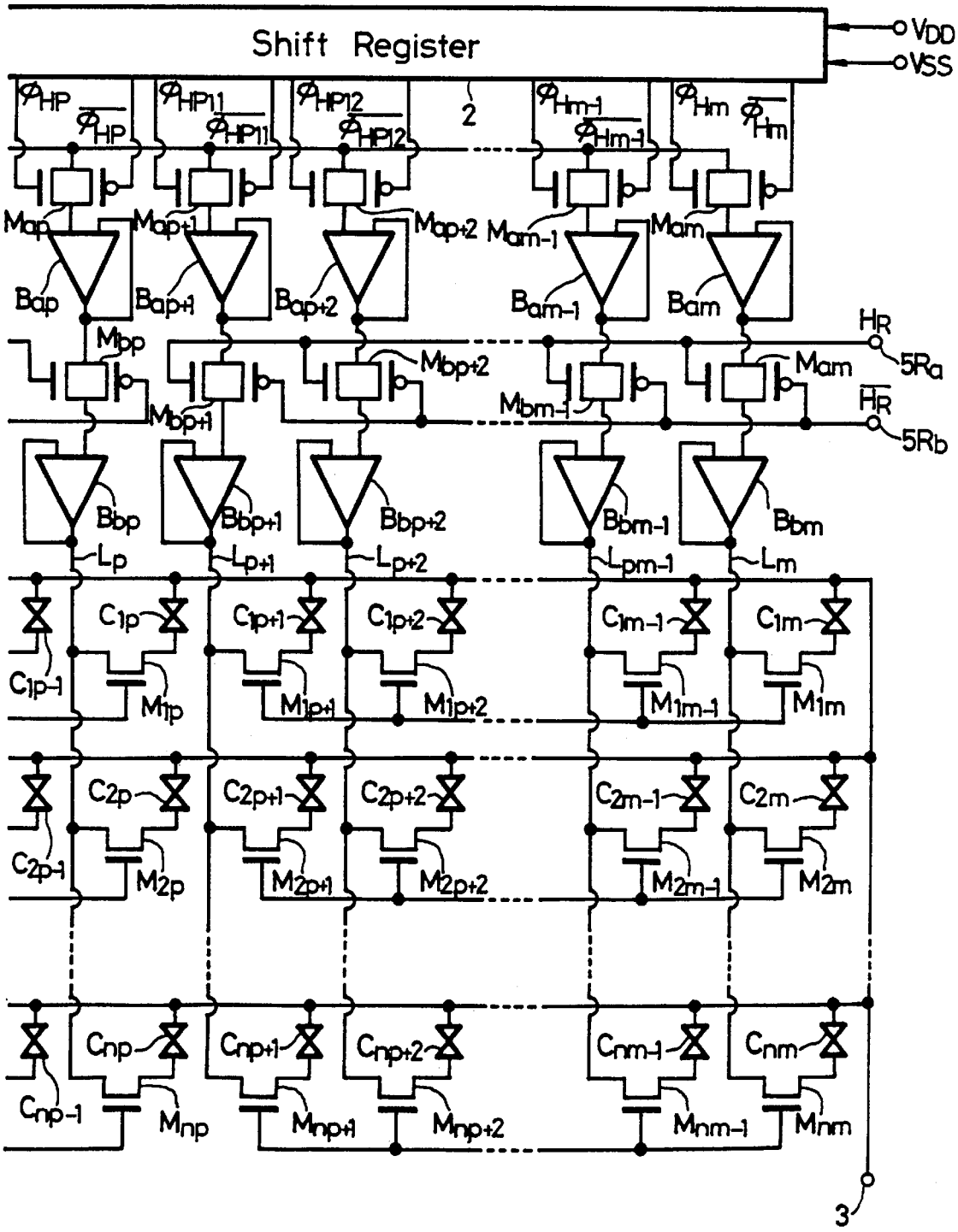
FIG. 11 (formed of FIGS. 11A and 11B drawn on two sheets of drawings so as to be of sufficiently large scale) is a schematic diagram showing a liquid crystal display device according to a second embodiment of the present invention.

FIG. 11 (formed of FIGS. 11A and 11B drawn on two sheets of drawings to permit the use of a suitably large scale) is a schematic diagram showing an overall arrangement of a liquid crystal display device according to a second embodiment of the present invention, in which the above-mentioned shading in the right end portion of the picture screen is avoided and in which all circuit elements are formed by a so-called on chip-fashion. In FIG. 11, like parts corresponding to those of the first embodiment of FIG. 3 are marked with the same references and therefore need not be described in detail.

Referring to FIG. 11, the CMOS elements $M_{b1}$ to $M_{bm}$ forming loading means are divided to provide, for example, left and right two groups ($M_{b1}$ to $M_{bp}$ and $M_{bp+1}$ to $M_{bm}$). Load signals $H_L$ and $\overline{H_L}$ applied to terminals 5La and 5Lb are supplied to control terminals of the elements $M_{b1}$ to $M_{bp}$, whereas load signals $H_R$ and $\overline{H_R}$ applied to terminals 5Ra and 5Rb are supplied to control terminals of the elements $M_{bp+1}$ to $M_{bm}$. Other elements are constructed similarly to those of the first embodiment of FIG. 3 and therefore need not be described in detail.

In this liquid crystal display device of the second embodiment, as shown in FIG. 12C, the load signal $H_L$ is given the same waveform as that of the prior-art horizontal blanking pulse, and the load signal $H_R$ is formed as a signal having a horizontal blanking pulse period and an extended period.

When an input video signal shown in FIG. 12A is applied to the input terminal 1, drive pulses $\phi_{H1}$ to $\phi_{HP}$ and $\phi_{HP+1}$ to $\phi_{Hm}$ shown in FIG. 12B are supplied to control terminals of elements $M_{a1}$ to $M_{ap}$ and $M_{ap+1}$ to $M_{am}$ of horizontal switching means connected to the loading means which are divided as the above-described two groups. In that case, the load signals $H_L$ and $H_R$ are provided as shown in FIG. 12C.

Figures 13A, 13B, 13C, 13D, 13E, 13F:
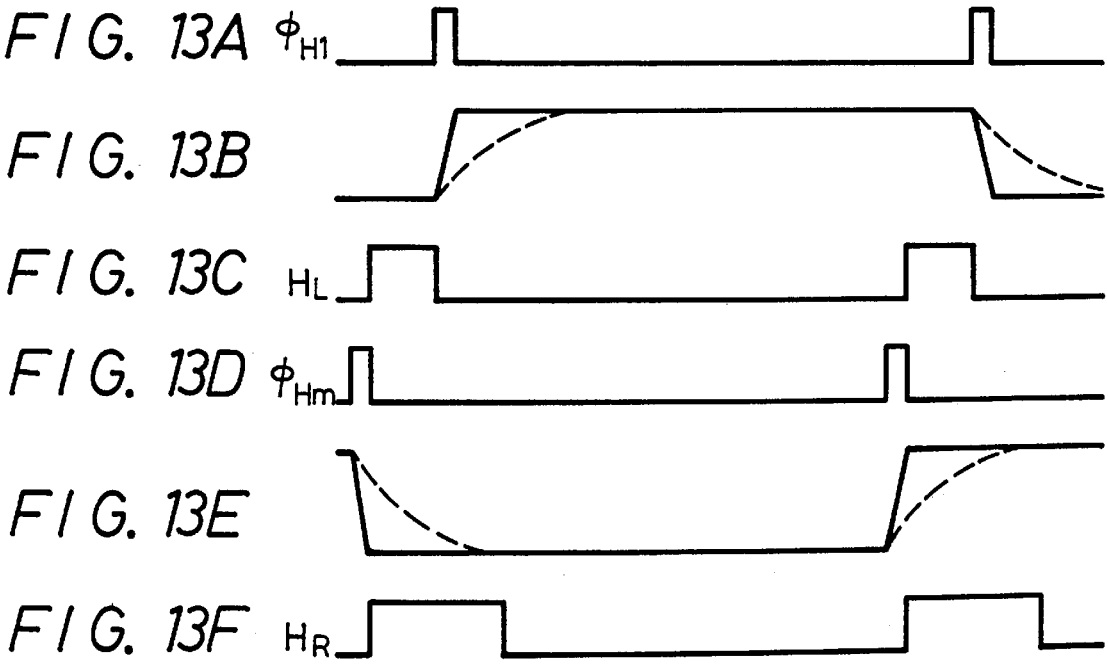
FIGS. 13A to 13F are like waveform diagrams used to explain the operation of the second embodiment of this invention, respectively.

Accordingly, in this liquid crystal display device, the signals are sampled and loaded for the lines $L_1$ to $L_p$ as shown in FIGS. 13A to 13C similarly as described above in the first embodiment. Whereas, for the lines $L_{p+1}$ to $L_m$, a signal sampled by the drive pulse $\phi_{Hm}$, which corresponds to the right end portion of the picture screen as shown in FIG. 13D, is moved in the switching element $M_{am}$ as shown by a solid line in FIG. 13E, and is moved in the buffer amplifier $B_{am}$ as shown by a broken line in FIG. 13E. In this embodiment, the rear portion of the load signal $H_R$ is extended as shown in FIG. 13F so that the signal, which rose finally, is loaded to thereby avoid a so-called shading from occurring at the right end portion of the picture screen.

Because the buffer amplifiers $B_{b1}$ to $B_{bn}$ are sufficient to charge the lines $L_1$ to $L_m$ during a period of time of the horizontal effective picture screen, a slow moving speed of a signal does not cause any trouble. Therefore, charge amounts of all liquid crystal cells can be rewritten satisfactorily, whereby an excellent display picture having no shading or the like can be obtained.

As described above, according to the liquid crystal display device of the present embodiment, the loading means is divided to provide the two groups of loading means, whereby the supply (load) period in which the signal is supplied to the signal line of at least the right end portion can be extended to the rear side. Thus, the signal movement in the holding means can be effected satisfactorily so that the respective signal lines are sufficiently charged by the signals, making it possible to prevent the quality of the display image from being deteriorated.

Although the elements $M_{a1}$ to $M_{am}$ and $M_{b1}$ to $M_{bm}$ are all formed of CMOS elements in the above-described liquid crystal display device, these elements may be formed of PMOS or NMOS elements.

Further, in the above-described liquid crystal display device of the present embodiment, the trailing edge of the load signal $H_R$ can be extended by a desired length before the elements $M_{ap+1}$ to $M_{am}$ to be connected are turned ON next. In the second embodiment as described above, the trailing edge of the load signal $H_R$ can be extended as shown by a broken line in FIG. 12C. Whereas, the leading edge of the load signal $H_L$ can be extended just after the elements $M_{a1}$ to $M_{ap}$ to be connected are turned ON as shown by a broken line in FIG. 12C. In that case, the ON-state period of the drive pulse signals $\phi_{V1}$ to $\phi_{Vn}$ supplied to the gate lines $G_1$ to $G_n$ must be reduced to cause the load signal $H_R$ to fall at a timing before the leading edge of the load signal $H_L$. In that case, the load of the load means is reduced so that the extended length of the leading edge of the loading signal $H_L$ is determined arbitrarily in consideration of the loads of the load means and of the switching elements $M_{11}$ to $M_{nm}$.

According to the second embodiment of the present invention, the loading means is divided to provide the two groups of loading means, whereby the supply (load) period in which the signal is supplied to the signal line of at least the right end portion can be extended to the rear side. Thus, the signal movement in the holding means can be effected satisfactorily so that the respective signal lines are sufficiently charged by the signals, making it possible to prevent the quality of the display image from being deteriorated.

Figure 14B:
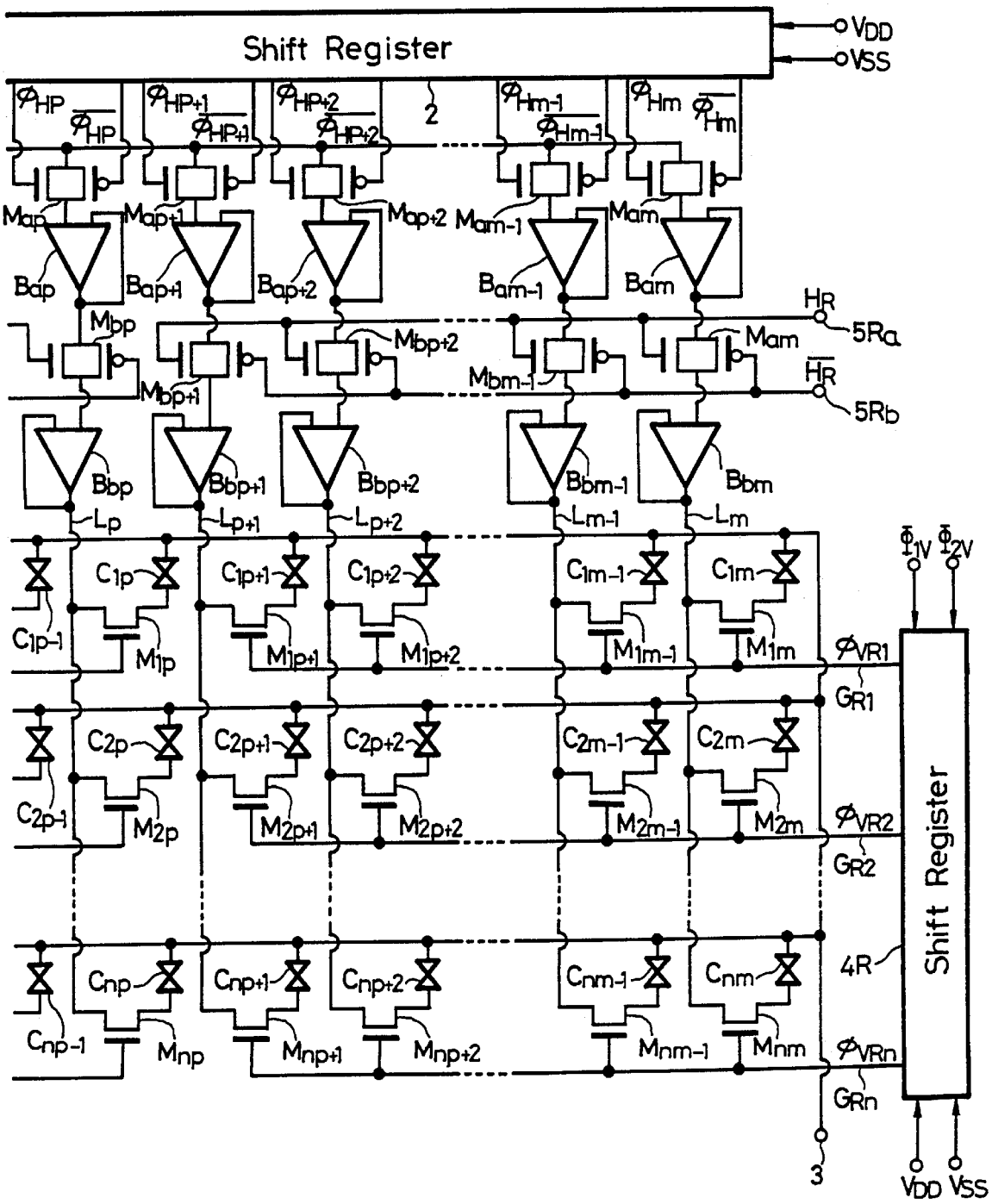
FIG. 14 (formed of FIGS. 14A and 14B drawn on two sheets of drawings to permit the use of a suitably large scale) is a schematic diagram showing a liquid crystal display device according to a third embodiment of the present invention.

FIG. 14 (formed of FIGS. 14A and 14B to permit the use of a suitably large scale) illustrates an improved liquid crystal display device according to a third embodiment of the present invention. In FIG. 14, like parts corresponding to those of the second embodiment shown in FIG. 11 are marked with the same references and therefore need not be described in detail.

As FIG. 14 shows, in association with the CMOS elements $M_{b1}$ to $M_{bm}$ divided to the left and right groups and forming the load means, gate lines in the horizontal (X-axis) direction are divided left and right to provide gate lines $G_{L1}$, $G_{L2}$, . . . , $G_{Ln}$ and $G_{R1}$, $G_{R2}$, . . . , $G_{Rn}$. These divided gate lines $G_{L1}$ to $G_{Ln}$ and $G_{R1}$ to $G_{Rn}$ are supplied with independent drive pulses $\phi_{VL1}$ to $\phi_{VLn}$ and $\phi_{VR1}$ to $\phi_{VRn}$ from shift registers 4L and 4R which are independently provided for the above-described gate lines $G_{L1}$ to $G_{Ln}$ and $G_{R1}$ to $G_{Rn}$.

In this liquid crystal display device, the load signals $H_L$, $H_R$ and the drive pulse signals $\phi_{VL1}$ to $\phi_{VLn}$ and $\phi_{VR1}$ to $\phi_{VRn}$ are provided as will be described hereinunder with reference to FIGS. 15A to 15E.

Figures 15A, 15B, 15C, 15D, 15E:
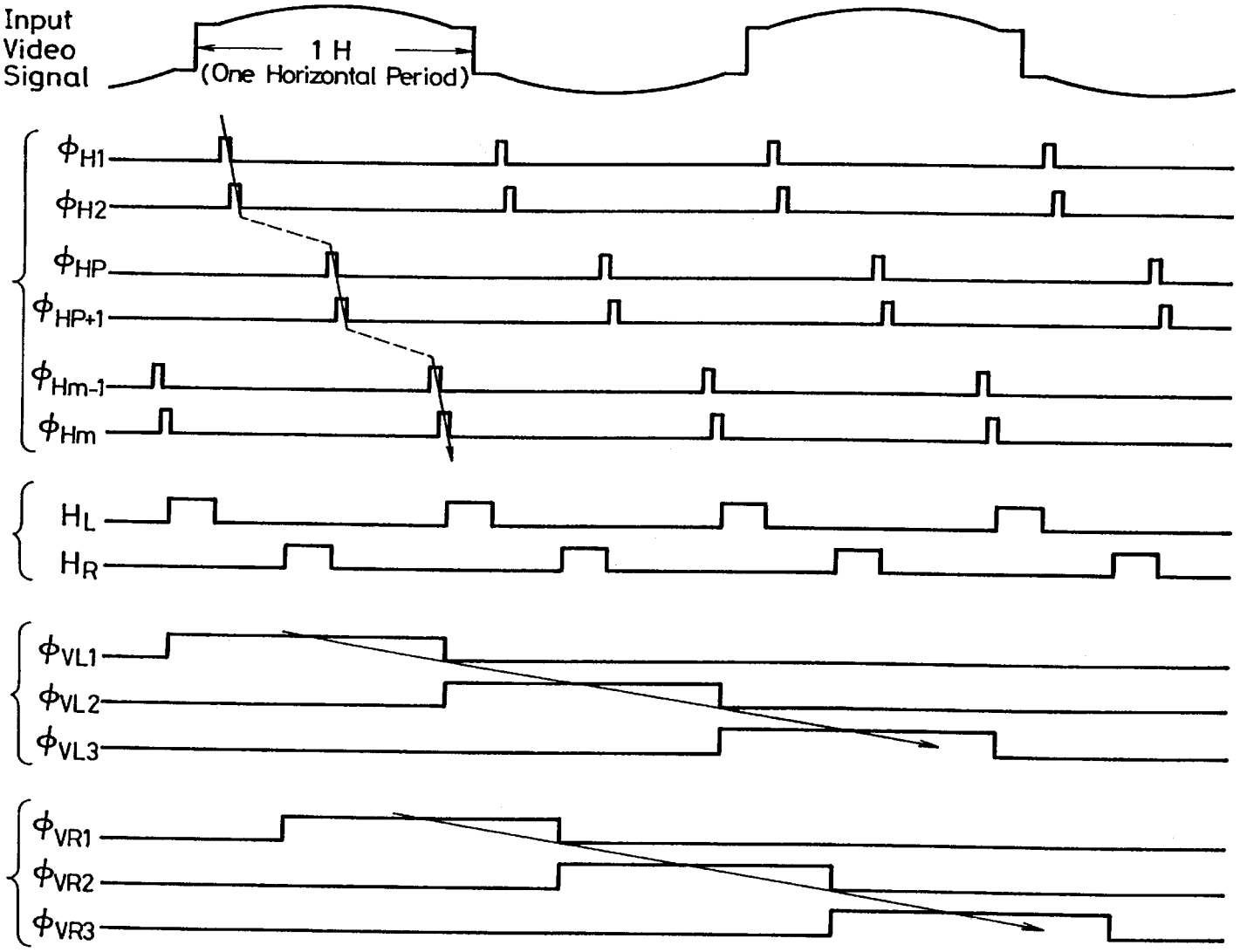
FIGS. 15A to 15E are waveform diagrams of an input video signal, a drive pulse signal and a load signal, and to which reference will be made in explaining an operation of the third embodiment of this invention, respectively.

When an input video signal shown in FIG. 15A is supplied to the liquid crystal display device of the third embodiment, drive pulse signals $\phi_{H1}$ to $\phi_{HP}$ and $\phi_{HP+1}$ to $\phi_{Hm}$ whose waveforms are shown in FIG. 15B are respectively supplied to control terminals of elements $M_{a1}$ to $M_{ap}$ and $M_{ap+1}$ to $M_{am}$ of the horizontal switching means connected to the thus divided left and right load means groups. The load signals $H_L$ and $H_R$ are provided as shown in FIG. 15C, and the drive pulse signals $\phi_{VL1}$, $\phi_{VL2}$, . . . , $\phi_{VR1}$, $\phi_{VR2}$, . . . , are provided as shown in FIGS. 15D and 15E.

Accordingly, in the aforementioned liquid crystal display device, the signals are sampled and loaded for the lines $L_1$ to $L_p$ similarly to the prior art. Whereas, for the lines $L_{p+1}$ to $L_m$, the signals sampled by the drive pulse signals $\phi_{HP+1}$ to $\phi_{Hm}$, are loaded by the load signal $H_R$ so that the signals, which fully rose, are loaded similarly to the lines $L_1$ to $L_P$.

Further, the drive pulse signals $\phi_{VR1}$ to $V_{Rn}$ supplied to the gate lines $G_{R1}$ to $G_{Rn}$ corresponding to these lines $L_{P+1}$ to $L_m$ rise with reference to the load signal $H_R$ as shown in FIGS. 15C and 15E, whereby the thus loaded signals are moved in the buffer amplifiers $B_{bp+1}$ to $B_{bm}$ during a period of time equivalent to those of the lines $L_1$ to $L_p$, making it possible to charge the lines $L_{P+1}$ to $L_m$ satisfactorily. Therefore, the occurrence of the shading at the right end portion of the picture screen can be avoided because the gate line G in the horizontal direction is divided to provide the left and right gate lines so that the gate lines $G_{R1}$ and $G_{L2}$, for example, can be made high in level simultaneously.

In the arrangement of the second embodiment shown in FIG. 11, the gate line in the horizontal direction is not divided with the result that the right portion of the gate line $G_1$ and the left portion of the gate line $G_2$ can not be made high in level simultaneously. If the gate lines $G_1$ and $G_2$ are made high in level simultaneously, then the video signal loaded to the vertical signal line is simultaneously inputted to the two horizontal lines. As a result, in the arrangement of the second embodiment shown in FIG. 11, the video signal can not be loaded on the vertical signal line of the right half portion with enough time.

Whereas, in the liquid crystal display device of the third embodiment shown in FIG. 14, the minimum transistion time in the buffer amplifiers $B_{a1}$ to $B_{am}$ is determined as $$\text{Horizontal effective picture screen period}/2+(H_L \text{ or } H_R)$$

Accordingly, the transition time in the buffer amplifiers $B_{b1}$ to $B_{bm}$ becomes one horizontal period, making it possible to carry out the satisfactory signal transition.

Since the signal transition time is sufficient, characteristics of buffer amplifiers can be determined with much freedom, and therefore the designing thereof or the like can be carried out with ease. Further, the charge amounts of all liquid crystal cells can be rewritten satisfactorily, thereby displaying a satisfactory picture having no shading or the like.

According to the liquid crystal display device of the third embodiment, the load means and the second signal line are divided to provide the groups and they are independently driven, whereby the period in which the signal is supplied (loaded) at least to the signal line of the right end portion can be moved to the rear side. Thus, the signal transition in each of the buffer amplifiers is satisfactorily carried out so that the signal lines are charged by the signals satisfactorily. Therefore, the quality of display picture can be prevented from being deteriorated.

While the elements $M_{a1}$ to $M_{am}$ and $M_{b1}$ to $M_{bm}$ are all formed of CMOS elements in the aforementioned liquid crystal display device, they may be formed of P-type or N-type MOS elements.

Further, in the above-described liquid crystal display device, the gate line is divided to provide groups and scanning means are provided at every divided groups, whereby the loads on the scanning means are reduced and the signals at the respective portions on the signal lines rise early. Thus, the quality of the displayed picture can be prevented from being deteriorated.

Having described preferred embodiments of the invention with reference to the accompanying drawings, it is to be understood that the invention is not limited to those precise embodiments and that various changes and modifications thereof could be effected by one skilled in the art without departing from the spirit or scope of the invention as defined in the appended claims.

I claim as my invention:

1. A liquid crystal display device in which a plurality of first signal lines are extended in parallel to each other in a vertical direction and a plurality of second signal lines are extended in parallel to each other in a horizontal direction wherein liquid crystal cells are respectively provided at intersections of said first and second signal lines through selecting elements, comprising;

horizontal scanning means having output portions corresponding to said first signal lines;

a plurality of horizontal switch means which are sequentially turned ON by pulse signals produced from the output portions of said horizontal scanning means, a horizontal effective period being the period during which said horizontal switch means are sequentially turned ON with each of said horizontal switch means being turned ON within each horizontal effective period;

a plurality of hold means supplied with an input video signal through said horizontal switch means; and a plurality of load means for respectively supplying signals from said hold means to said first signal lines, wherein said load means are only turned ON between successive horizontal effective periods.

2. A liquid crystal display device according to claim 1, wherein said second signal lines are divided in the horizontal direction into a plurality of groups and vertical scanning means are independently provided at every divided group to drive said second signal lines.

3. A liquid crystal display device in which a plurality of first signal lines extend in parallel to each other in a vertical direction and a plurality of second signal lines extend in parallel to each other in a horizontal direction, wherein liquid crystal cells are respectively provided at intersections of said first and second signal lines through selecting elements, said device comprising:

horizontal scanning means having output portions corresponding to the first signal lines;

a plurality of horizontal switch means which are sequentially turned ON for a horizontal effective period by pulse signals sequentially produced from the output portions of the horizontal scanning means;

a plurality of hold means which are supplied with input video signals through said horizontal switch means; and a plurality of load means each of which supplies input video signal from said hold means to the first signal lines throughout all of said horizontal effective period, wherein said load means are divided in the horizontal direction to provide a plurality of groups with said groups being controlled by a respective plurality of load signals so that the load means at every divided group are turned on during a period other than a period in which the horizontal switch means belonging to the load means of at least said group are turned ON whereby said input video signals are completely transferred to said first signal line.

4. A liquid crystal display device according to claim 3, wherein said load means comprises a gate circuit and a buffer amplifier connected to the gate circuit.

5. A liquid crystal display device according to claim 4, wherein said gate circuit comprises a CMOS element.

6. A liquid crystal display device according to claim 3, wherein said selecting elements and said first and second signal lines are formed on a single integrated circuit substrate.

7. A liquid crystal display device in which a plurality of first signal lines extend in parallel to each other in a vertical direction and a plurality of second signal lines extend in parallel to each other in a horizontal direction, wherein liquid crystal cells are respectively provided at intersections of said first and second signal lines through selecting elements, comprising:

a horizontal scanning means generating sequential pulse signals;

a plurality of horizontal switch means which are sequentially turned on by the pulse signals;

a plurality of hold means which are supplied with input video signals through the horizontal switch means for a horizontal effective period; and a plurality of buffer circuits each of which loads input video signal from the hold means to the first signal lines throughout all of said horizontal effective period, wherein said input video signal is inverted in polarity at a predetermined cycle and charging and discharging paths within the buffer circuits are switched at a timing in which the video signal is inverted in polarity whereby said input video signals are completely transferred to said first signal lines.

8. A liquid crystal display device according to claim 7, wherein said buffer circuits comprises a gate circuit and buffer amplifier connected to the gate circuit.

9. A liquid crystal display device in which a plurality of first signal lines extend in parallel to each other in a vertical direction and a plurality of second signal lines extend in parallel to each other in a horizontal direction, wherein liquid crystal cells are respectively provided at intersections of said first and second signal lines through selecting elements, said device comprising:

a horizontal scanning means for generating sequential scanning pulse signals;

a plurality of horizontal switch means which are sequentially turned ON by the pulse signals;

a plurality of hold means which are supplied with an input video signal through the horizontal switch means; and a plurality of load means each of which supply input video signal from the hold means to the first signal lines throughout all of a horizontal effective period whereby said input video signals are completely transferred to said first signal lines.

10. A liquid crystal display device according to claim 9, wherein said horizontal effective period is greater than a horizontal blanking period.

11. A liquid crystal display device according to claim 9, wherein said load means are divided in the horizontal direction to provide a plurality of groups of load means that are controlled by a respective plurality of load signals with at least one load signal having a horizontal effective period greater than a horizontal blanking period.

12. A liquid crystal display device according to claim 11, wherein said plurality of groups comprises a first group and a second group and a load signal for said second group being said one load signal.

* * * * *